US010456626B2

(12) United States Patent
Groshek

(10) Patent No.: US 10,456,626 B2
(45) Date of Patent: Oct. 29, 2019

(54) BALANCE TRAINER EXERCISE DEVICE

(71) Applicant: The Slack Liner, LLC

(72) Inventor: Robert Wayne Groshek, Berwick, PA (US)

(73) Assignee: The Slack Liner, LLC

( * ) Notice: Subject to any disclaimer, the term of this patent is extended or adjusted under 35 U.S.C. 154(b) by 0 days.

(21) Appl. No.: 16/237,827

(22) Filed: Jan. 2, 2019

(65) Prior Publication Data

US 2019/0224530 A1 Jul. 25, 2019

Related U.S. Application Data

(60) Provisional application No. 62/709,551, filed on Jan. 22, 2018, provisional application No. 62/764,719, filed on Aug. 16, 2018.

(51) Int. Cl.

| | |
|---|---|
| ***A63B 26/00*** | (2006.01) |
| ***A63B 22/18*** | (2006.01) |
| ***A63B 22/16*** | (2006.01) |

(52) U.S. Cl.

CPC ..... *A63B 26/003* (2013.01); *A63B 22/16* (2013.01); *A63B 22/18* (2013.01)

(58) Field of Classification Search

CPC ..... A63B 26/003; A63B 26/006; A63B 4/00; A63B 7/08–7/085

See application file for complete search history.

(56) References Cited

U.S. PATENT DOCUMENTS

| | | | | |
|---|---|---|---|---|
| 1,301,963 A * | 4/1919 | Orton | A63B 4/00 482/34 |
| 1,747,721 A * | 2/1930 | Lowman | A63B 4/00 482/34 |
| 3,339,920 A | 9/1967 | Moritz | |
| 3,570,848 A * | 3/1971 | Bowen | A63B 7/08 482/34 |
| 3,658,325 A * | 4/1972 | Baker | A63B 7/08 482/34 |
| 3,754,757 A * | 8/1973 | Bowen | A63B 7/08 482/34 |
| 3,944,654 A * | 3/1976 | Moore | A63B 4/00 482/34 |
| 4,272,126 A * | 6/1981 | Cadle | A47C 3/029 297/271.5 |
| 5,769,756 A | 6/1998 | Parks | |

(Continued)

OTHER PUBLICATIONS

International Search Report and Written Opinion for International Application No. PCT/US2019/013423, dated Mar. 15, 2019.

*Primary Examiner* — Jennifer M Deichl

(74) *Attorney, Agent, or Firm* — Drinker Biddle & Reath LLP

(57) ABSTRACT

A balance tension exercise device includes a pair of spaced platforms interconnected by two rigid bars. A plurality of flexible straps span the two platforms. The bars have differing widths to provide different levels of difficulty by a user walking from one platform to another over the bars. Similarly, the straps have different widths to provide other levels of difficulty. Each platform may comprise the top wall of a box. One of the boxes is larger than the other box so that all of the components of the device can be stored in the larger box.

26 Claims, 8 Drawing Sheets

(56) References Cited

U.S. PATENT DOCUMENTS

| | | | | |
|---|---|---|---|---|
| 6,168,549 | B1 * | 1/2001 | Squibb | A63B 4/00 482/34 |
| 6,500,078 | B1 * | 12/2002 | Williams | A63B 69/0002 473/218 |
| 2008/0312043 | A1 * | 12/2008 | Cook | A63B 4/00 482/34 |
| 2012/0238421 | A1 * | 9/2012 | Klopman | A63B 7/085 482/142 |
| 2014/0329653 | A1 * | 11/2014 | Klopman | A63B 26/003 482/143 |
| 2018/0001126 | A1 * | 1/2018 | Klopman | A61B 5/6803 |

* cited by examiner

10

34
32
36
52
22b
22a
20a
20b
28
30
60
54
16
56
18
58
92
93
93
92
88
90
90
90
88
46
12
42
14
38
40
100

BALANCE TRAINER EXERCISE DEVICE

CROSS-REFERENCE TO RELATED APPLICATIONS

This application is based upon provisional application Ser. No. 62/709,551, filed Jan. 22, 2018 and Ser. No. 62/764,719, filed Aug. 16, 2018, all of the details of which are incorporated herein by reference thereto.

BACKGROUND OF THE INVENTION

Various exercise devices are known to maintain or develop different physical conditions. It would be desirable if an exercise device could be provided directed to developing or maintaining balance by the user of such device.

SUMMARY OF THE INVENTION

An object of this invention is to provide a balance trainer exercise device having various levels of balance requirements.

A further object of this invention is to provide such a device having multiple components which can be assembled together in a compact form for storage and transportation.

In accordance with this invention a balance trainer exercise device includes a pair of spaced platforms interconnected by two rigid bars of differing width so that each bar may be used as part of the exercise training by providing a first level for the wider bar and a second, more challenging level, for the narrower bar. A plurality of flexible straps are also mounted between the platforms with the straps, likewise, having differing widths to provide additional levels of difficulty for balance training.

Each platform may comprise the top wall of a hollow box. One of the boxes is of larger dimension than the other box so that the various components, including the smaller box, may be housed in the larger box to provide a compact unit for storage and transportation.

THE DRAWINGS

DETAILED DESCRIPTION

FIGS. 1-9 illustrate a preferred embodiment of this invention. As later described, the invention may be practiced with variations of the details of the device shown in FIGS. 1-9.

Figure 1:
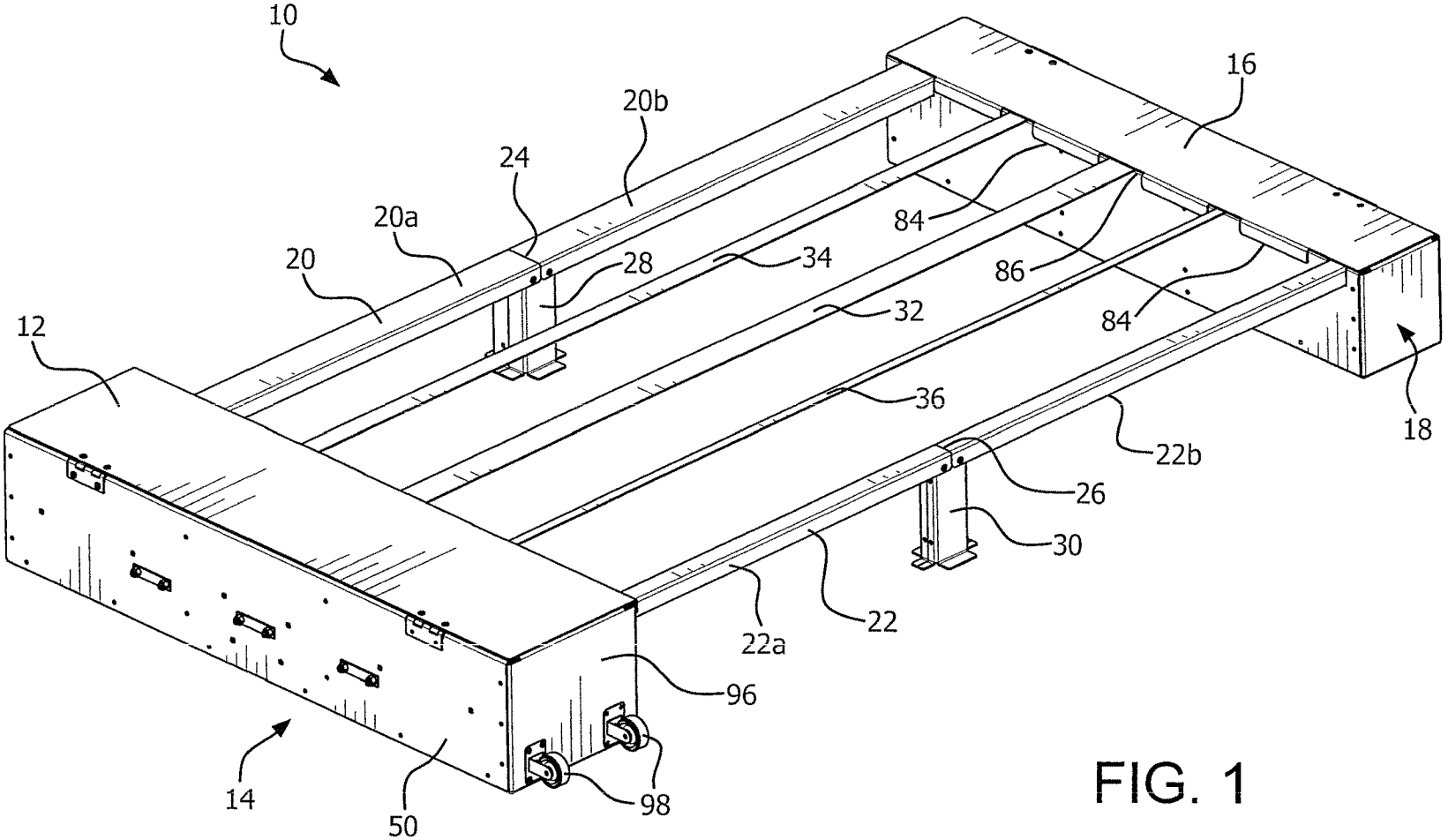
FIG. 1 is an isometric view of a balance trainer exercise device in accordance with this invention.

As shown in FIG. 1 the basic components of the balance trainer exercise device 10 are a platform 12 which is the top wall of a box 14 and a platform 16 which is the top wall of a box 18. As later described box 14 is of larger dimension than box 18 so that box 18 can be stored within the hollow interior of box 14.

The boxes 14,18 are interconnected by a first elongated rigid bar 20 and a second elongated rigid bar 22. The rigid bars 20 and 22 are formed from two bar segments abutting each other at the center 24,26 of each respective bar so that the bars may later be detached from the boxes 14,18 and the segments may be separated to be stored within box 14. A foot 28,30 is mounted below each respective bar 20,22 to provide support for the bars. In addition, the bar segments are detachably mounted to feet 28,30. Feet 28, 30 have multiple functions. One function is to provide support for the elongated bars. In addition, however, the feet provide structure for permitting the bar segments to be mounted in abutment with each other as indicated by the reference numerals 24,26. If desired, the segments could be connected in any other manner, such as by connection to intermediate structures or by connection to each other, such as by being hinged to each other so that one segment can be folded over the other segment.

FIG. 1 also illustrates a set, namely three elongated flexible straps, 32,34,36 located between the bars 20,22 and spanning the platforms 12,16. The bars and straps are preferably parallel to each other. The flexible straps have different widths, namely the central strap 32 is the widest strap, while the strap 36 is the narrowest strap and the strap 34 has an intermediate width. By having three different width straps, three additional levels of difficulty are provided for balance training.

In use the balance training is performed by a user first walking from one platform to the other on the upper exercise surface of bar 20, to provide a first level of difficulty for the balance training. When the user is sufficiently proficient at walking on level 1 bar 20 the user would then walk from one platform to the other on the upper exercise surface of narrower bar 22. After the user has mastered the two levels of difficulty from the rigid bars, the user would then proceed to the flexible straps having greater levels of difficulty. This would be done by sequentially walking on the upper exercise surface first at wider strap 32, then at intermediate strap 34 and finally at narrow strap 36.

Bars 20,22 may be made of any suitable material and may have any desirable shape. What is important is that each bar is rigid and has an upper exercise surface on which the user may walk during the balance training. The bar, for example, may be made of aluminum, wood, plastic, steel, fiberglass, carbon fiber, plastic wood or iron. The bars may be in the form of beams having a square or rectangular cross-section or could be angle irons or could be of any other suitable shape as long as the bars function to provide a surface for balance training. A channel shape is preferred. Preferably, bar 20 has a four inch upper exercise surface. The two segments 20*a* and 20*b* are each preferably four feet long. Similarly, bar 22 may be formed of two segments 22*a* and 22*b* each of which is four feet long. Thus, the overall length of each bar 20,22 in its use condition is eight feet. That length is reduced to a length of four feet when the segments are separated from each other so that the four foot segment length could facilitate storage as later described. Bar 22 preferably has an upper exercise surface width of two inches. It is to be understood that the invention may be practiced where each bar has only one segment, if the storage box has a comparable length, or each bar could have more than two segments to increase the overall length of the bar, yet permit the bar to separate into segments for storage purposes.

Each foot 28,30 is detachably mounted to its respective bar 20,22 for storage purposes. The feet 28,30 could be of any suitable structure capable of providing support for the respective bars, such as being of rectangular tubular form with outwardly extending bottom flanges as illustrated. The channel shaped bars 20,22 fit over the tops of the feet, connected by detachable fasteners.

Figure 3:
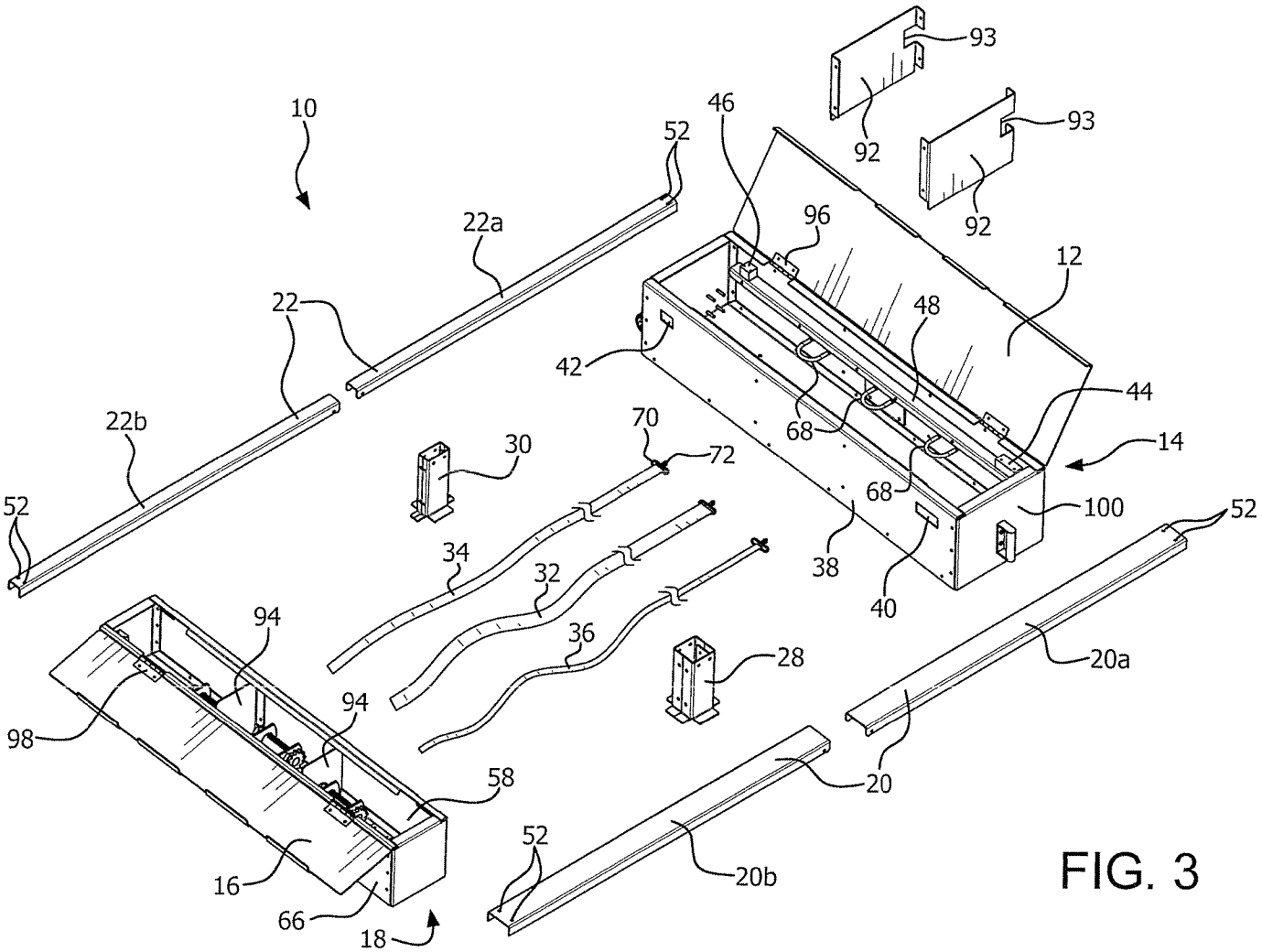
FIG. 3 is an assembly view of the device shown in FIGS. 1-2.

Bars 20,22 may be detachably mounted to the boxes 14,18 in any suitable manner. For example, as shown in FIG. 3 the inner wall 38 of large box 14 includes a pair of slots or openings 40,42 through which the respective bars 20,22 may be inserted. A pair of mounting blocks 44,46 is secured to a beam 48 at outer wall 50 of box 14. See also FIG. 6. Channel shaped bar 20 is placed over mounting block 44 and detachably secured by any suitable fasteners, such as screws or bolts, to holes 52. Similarly, bar 22 is placed over mounting block 46 and detachably secured by suitable fasteners through holes 52.

The opposite ends of bars 20,22 are secured to smaller box 18 in a similar manner. Thus, as shown in FIG. 4 smaller box 18 includes slots or openings 54,56 in inner wall 58 so that the respective bars may slide through the slots and be mounted to mounting blocks 60,62 on beam 64 at outer wall 66.

Figure 2:
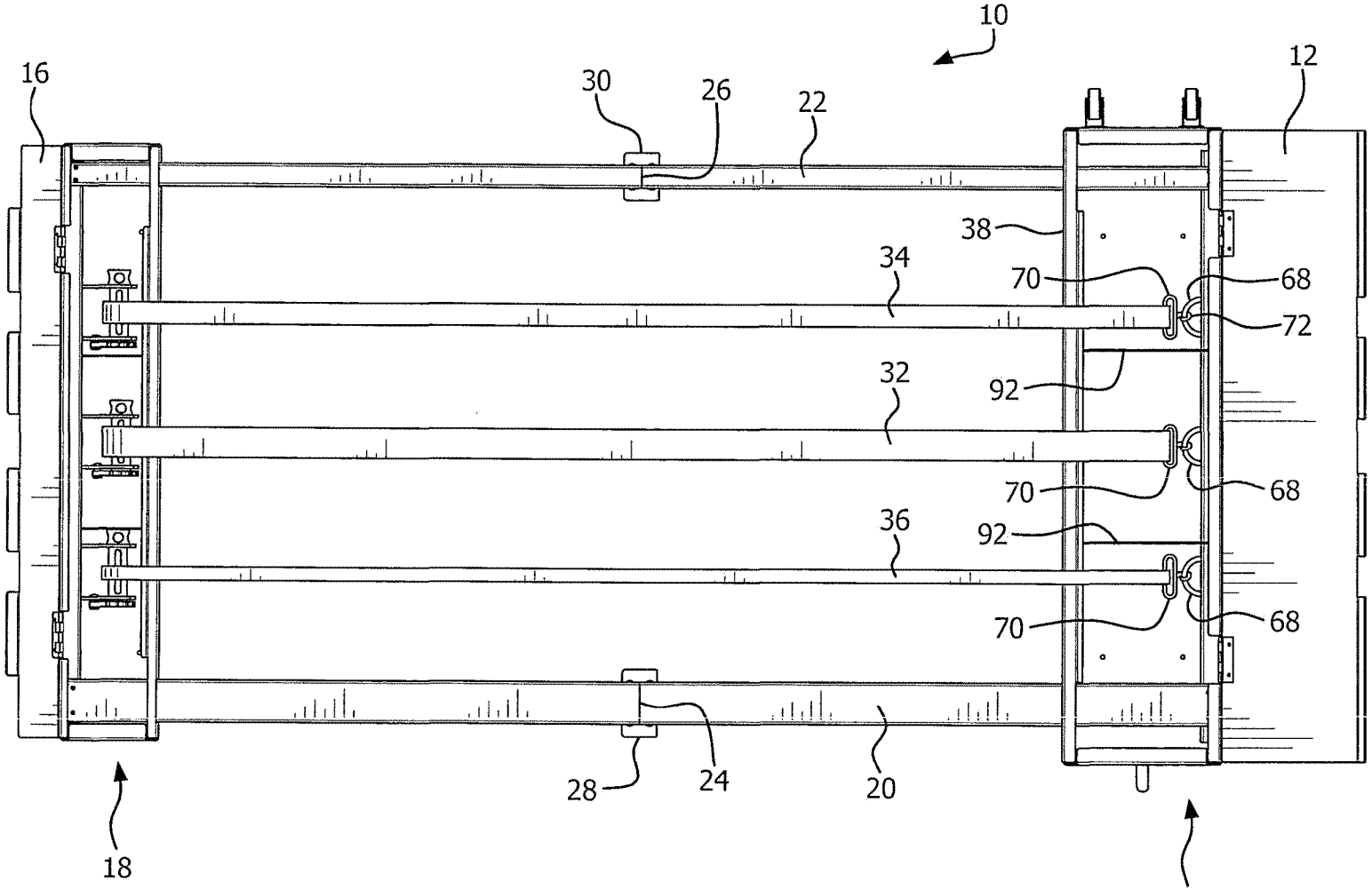
FIG. 2 is a top plan view of the device shown in FIG. 1.

Straps 32,34, and 36 may be mounted to boxes 14,18 in any suitable manner. For example, as shown in FIGS. 2-3 U-bolts or brackets 68 are mounted to the outer wall of box 14. Each strap 32,34,36 includes a loop 70 having a hook 72, such as a J hook which loops over the U-bolt or bracket 68 to detachably mount that respective end of the strap in box 14.

Figure 4:
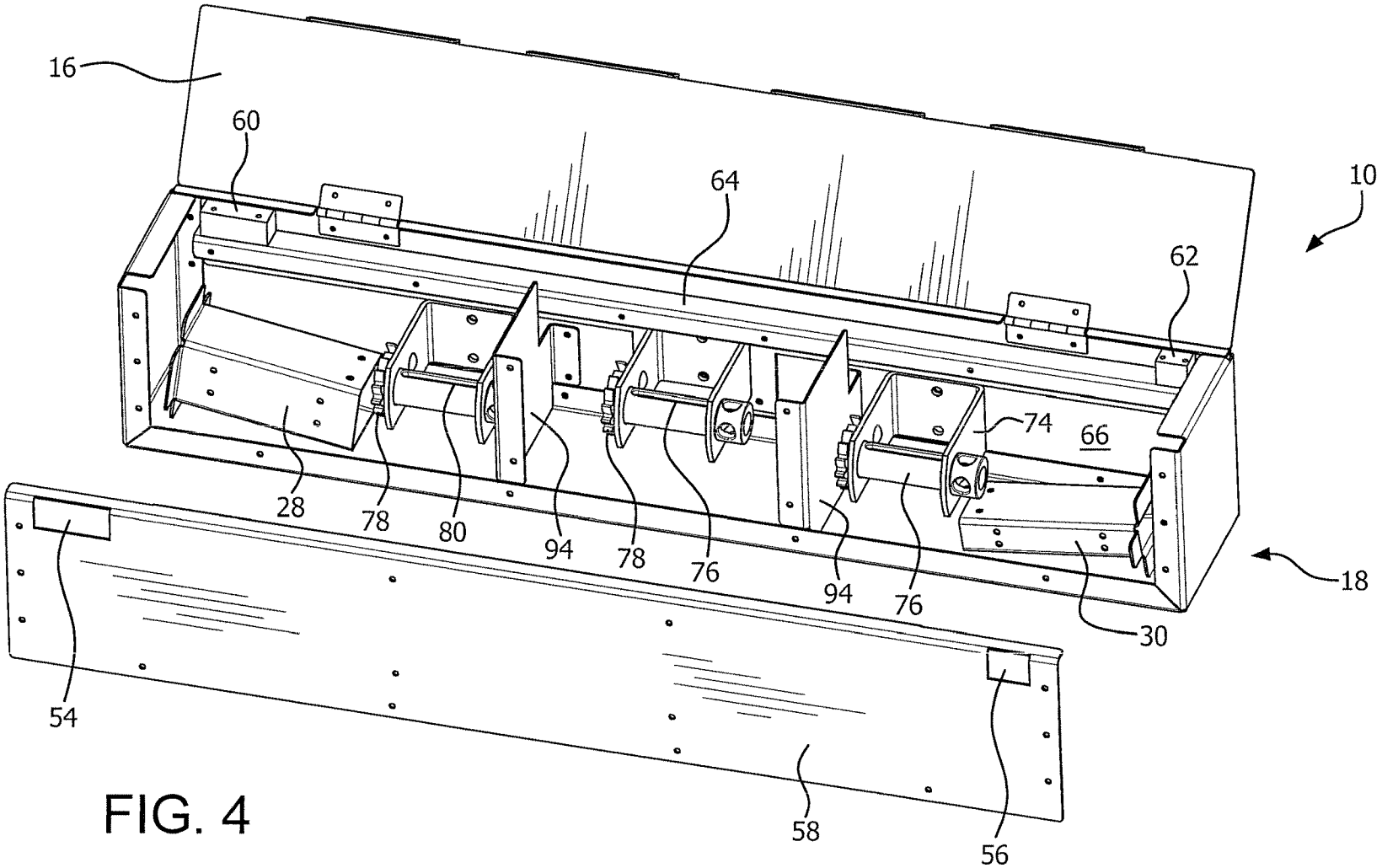
FIG. 4 is an isometric, assembly view of the smaller box component of the device shown in FIGS. 1-3 in a storage condition.

FIGS. 2 and 4 illustrate the structure for mounting straps 32,34 and 36 to smaller box 18. As shown therein, a set of three U-shaped brackets 74 is mounted to outer wall 66 of box 18. Each U-shaped bracket has aligned holes through which a slotted shaft 76 extends. Each shaft 76 is connected to a ratchet 78 outwardly of its bracket 74. An end of each strap is inserted through slot 80 to mount the end of each strap to the respective bracket 74 and secured in any suitable manner. As a result, each end of each strap is connected to a respective box 14,18.

The tension in the flexible straps 32,34,36 can be adjusted by rotation of its respective ratchet 78 and that degree of tension could be fixed or maintained by engagement of pawl 82 in the appropriate tooth of ratchet 78. See FIG. 8-9. The provision of such a tensioning device permits a large degree of adjustability in the tautness or in the slack of the appropriate strap to thereby provide a wide selection of different levels of difficulty for the balance training when the straps are being used.

If desired, the tensioning of the straps could be controlled by having the tensioning structure in large box 14 instead of or as well as in small box 18.

Figure 5:
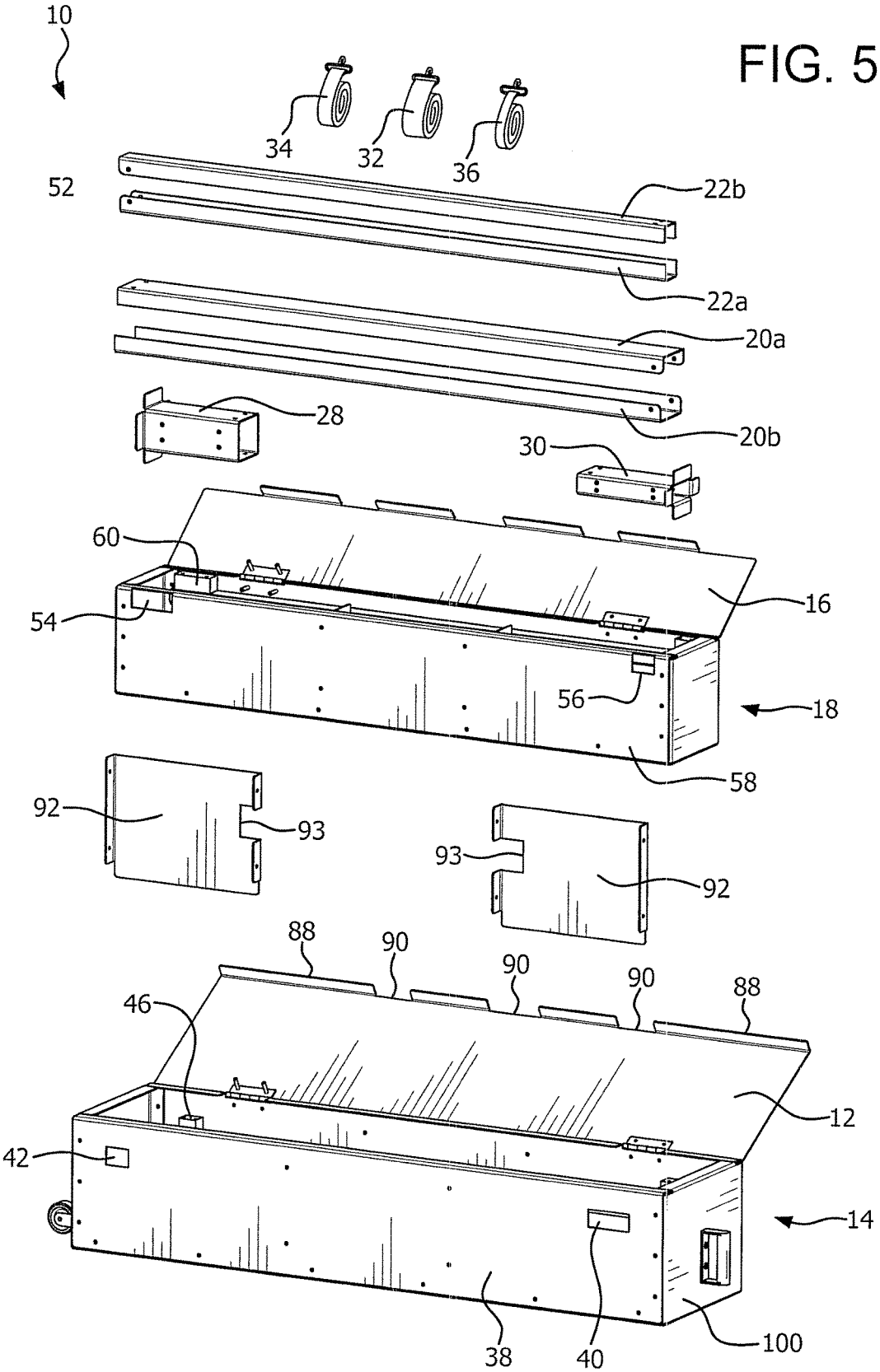
FIG. 5 is an assembly view of the device shown in FIGS. 1-4 in a storage/transport condition.

As shown in FIG. 1, the platform or upper wall 16 of box 18 includes a downwardly extending lip 84 having three cut-outs 86 to permit the respective straps to pass through box 18. Similarly, as shown in FIG. 5, the platform or upper wall 12 of box 14 includes a lip 88 having three cut-outs 90 to accommodate straps 32,34 and 36.

In order to provide support for platform 12 a pair of support plates 92,92 is mounted inside box 14 between respective pairs of U brackets 68,68. Each plate rests on the bottom wall of box 14 and is secured to the inner and outer walls in contact with upper wall or platform 12 when the upper wall is in its closed position. Plates have notches 93 to accommodate beam 48. The support plates 92,92 are detachable for later storage. Similarly, smaller box 18 includes a pair of support plates 94 which are, but need not be, detachably mounted in box 18. Plates 94 have notches to accommodate beam 64. See FIG. 4. The support plates 94 contact the upper and the lower walls, as well as the inner and outer walls of box 18 in the manner of plates 92.

An advantageous feature of the invention is the ability to detach the various components so that box 14 can house all of the components to provide a compact unit for storage and transport of device 10. In order to achieve this result it is necessary to selectively have access to the interior of each box. Each box includes an inner wall, an outer wall, two end walls, a bottom wall and a top wall. In the broad practice of this invention any of these walls could be movable or removable to gain access to the interior of the box. In the preferred practice of this invention, however, it is the top wall or platform which is movable to expose or gain access to the interior of the respective box. As shown in FIG. 3 top wall or platform 12 is connected to the outer wall of box 14 by a set of hinges 96. Similarly, top wall or platform 16 of box 18 is connected to outer wall 66 by a set of hinges 98. The ability to open each box at its top wall not only achieves the later described storage/transport advantage but also provides the ability to gain access to the different components such as the straps and bars that have their mounting structures within the boxes.

FIG. 4-9 illustrate the manner of providing the compact storage/transport ability of device 10. As shown in FIG. 4 the straps 32,34,36 have been removed from the shafts 76. If desired, however, the straps can remain attached to the shafts and can be stored in a rolled or folded condition in the smaller box 18. Feet 28,30 are detached from bars 20,22 and stored in smaller box 18.

Figure 6:
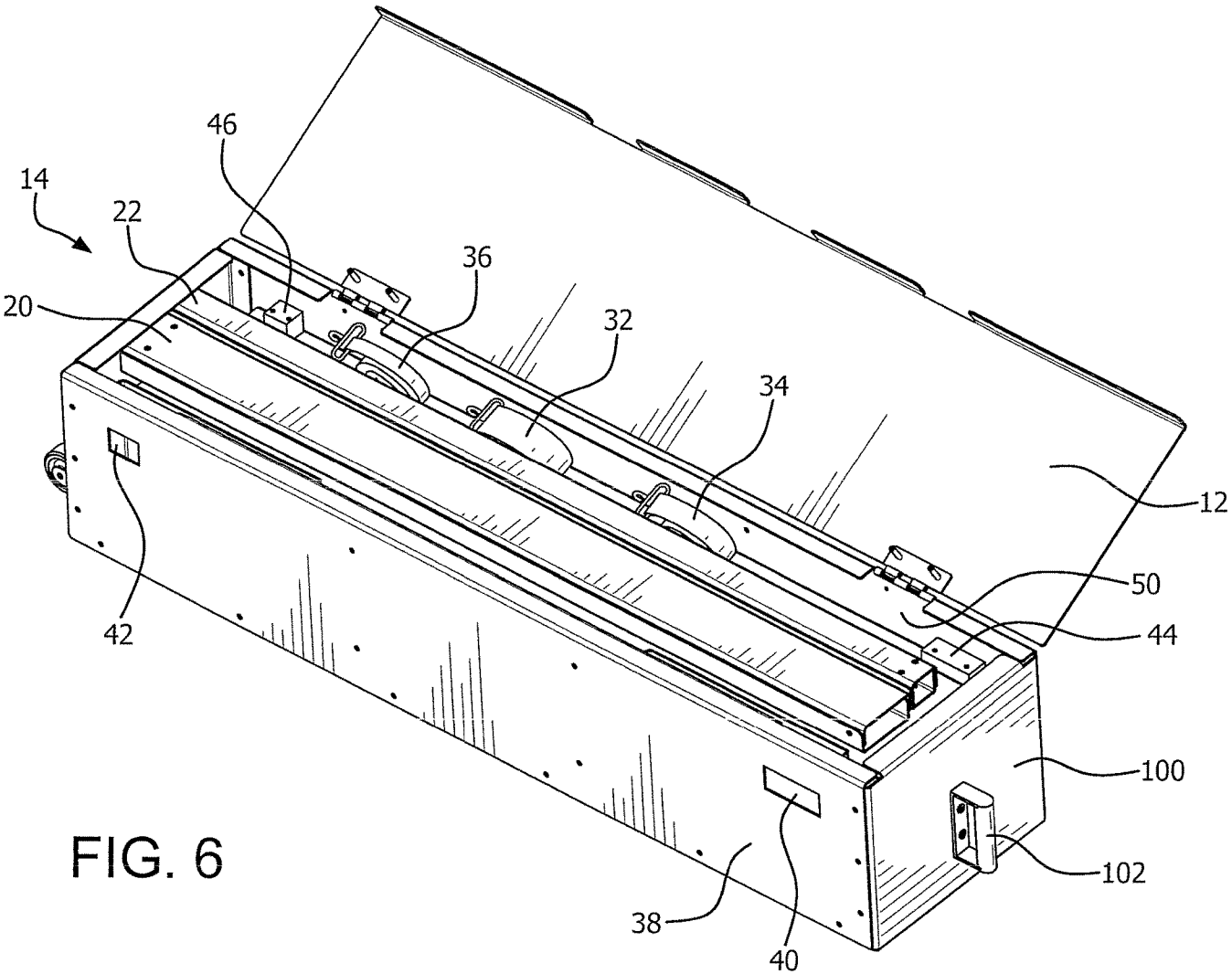
FIG. 6 is an isometric view of the larger box of the device shown in FIGS. 1-3 in its storage condition.
Figure 7:
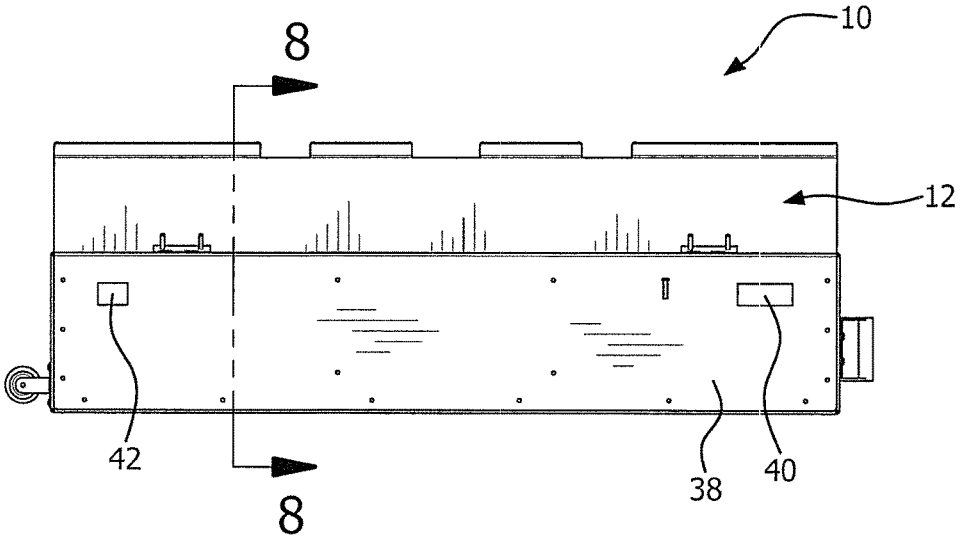
FIG. 7 is a side elevational view of the device of FIGS. 1-6 in the storage/transport condition but, with the top wall partially open.
Figure 8:
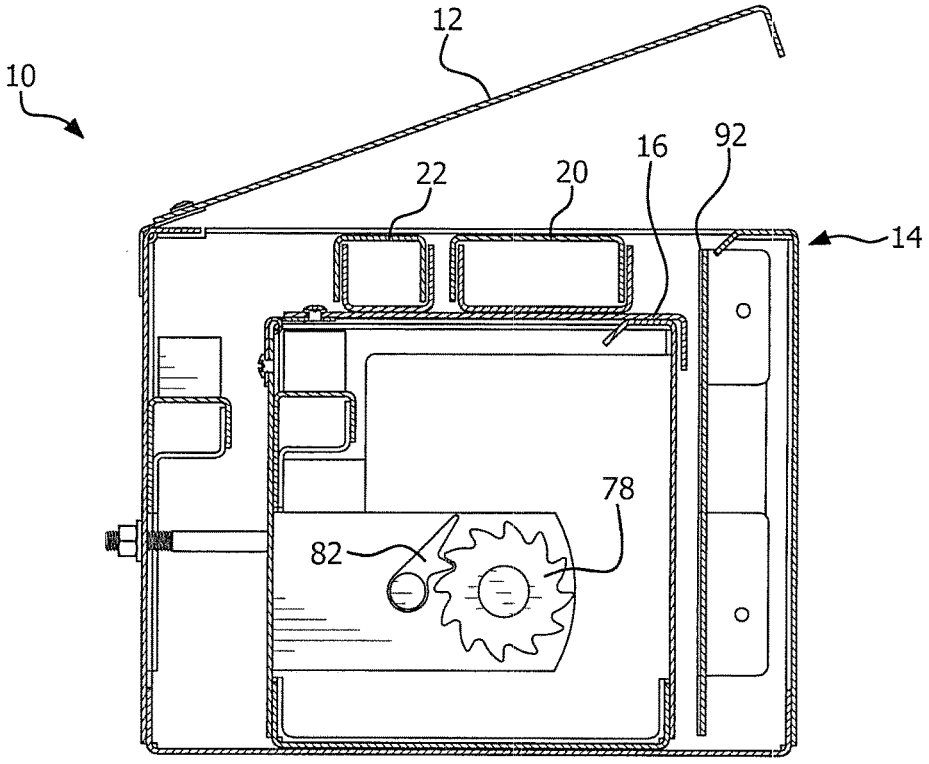
FIG. 8 is a cross-sectional view taken through FIG. 7 along the line 8-8.
Figure 9:
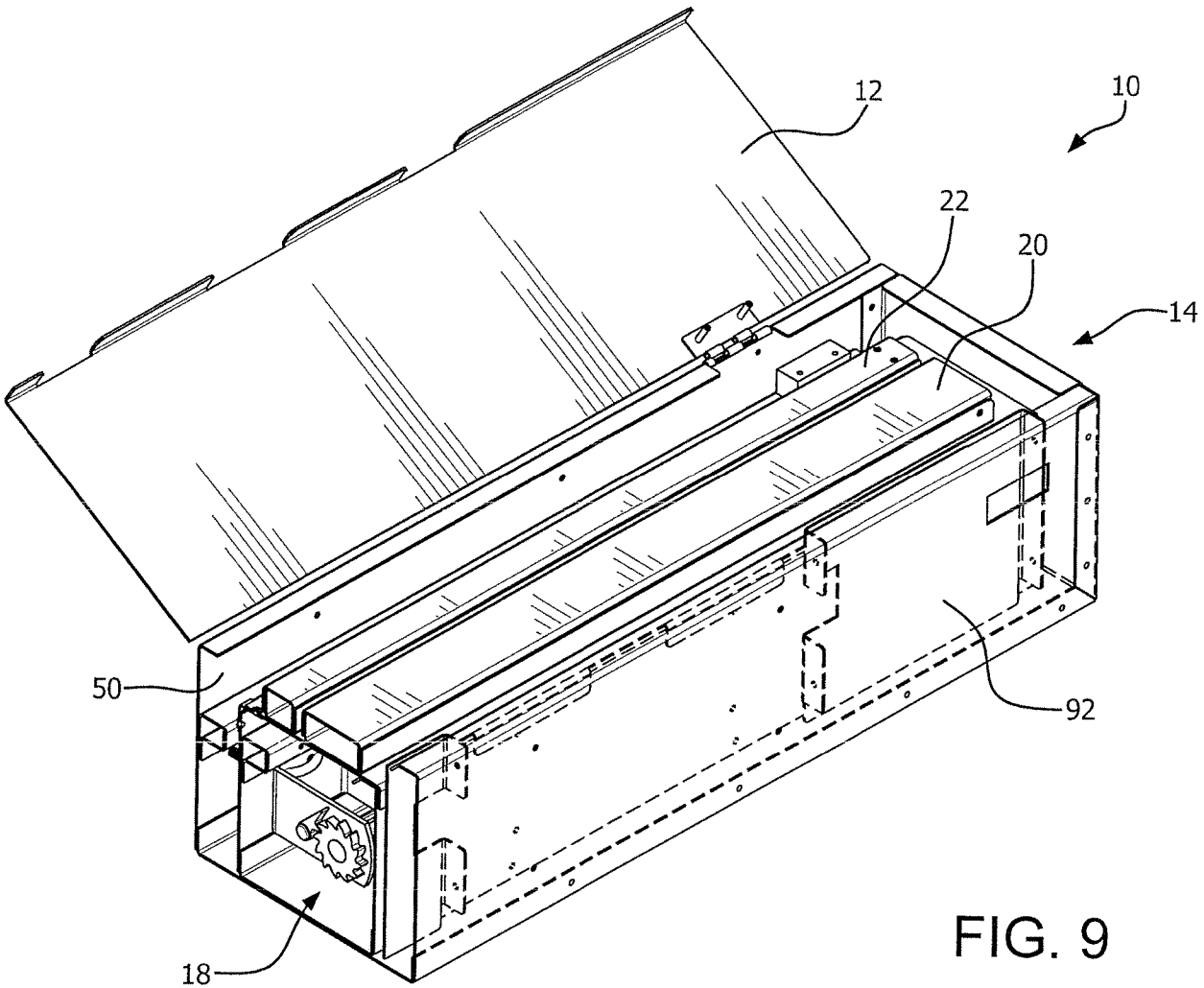
FIG. 9 is an isometric view of the device shown in FIGS. 7-8.

As shown in FIG. 5 the bars 20,22 are detached from feet 28,30 thus, separating the bar segments 20*a* from 20*b* and segments 22*a* from 22*b*. The support plates 92,92 are removed from the interior of box 14 to create space for the later insertion of box 18. Straps 32,34 and 36 are detached from box 14 and are maintained totally separate or could be left attached to shafts 76 in box 18. Box 18 is closed and is placed inside box 14. The bar segments 20*a*, 20*b*, 22*a* and 22*b* are placed in box 14 on top of box 18 as shown in FIG. 6. Where the straps 32,34,36 are not stored in box 18 the straps could be placed along the bar segments as also shown in FIG. 6. Preferably the straps are stored in smaller box 18. The support plates 92,92 which have been detached from the inner and outer walls of box 14 would be placed in box 14 between box 18 and inner wall 38. As shown in FIGS. 8 and 9 upper wall or platform 12 would then be closed.

As shown in FIGS. 1, 2 and 5-7 the end wall 96 of box 14 is provided with a set of wheels 98 to facilitate moving the stored unit of device 10. The opposite end wall 100 is provided with a handle 102 so that the stored unit can be pushed or pulled. Thus device 10 is completely portable.

Any suitable dimensions may be used for the components of device 10. For example, the bar 20 may have a width of 3-5 inches and preferably 4 inches. Bar 22 may have a width of 1-3 inches and preferably 2 inches. Strap 32 may have a width of 3-5 inches and preferably 4 inches. Strap 34 may have a width of 1½ inch-2½ inches and preferably 2 inches, while strap 36 may have a width of ½ inch-1½ inches and preferably 1 inch. The straps may be made of any suitable material, such as fiberglass, cloth, polyester or any other flexible material. The boxes could be made of a rigid material, such as aluminum, wood, plastic, steel, fiberglass, carbon fiber, plastic wood or iron. Preferably, the bars 20,22 have an overall length of 8 feet but that the length could be more or less as desired, such as 6-10 feet. Box 14 is greater in dimension than box 18. In preferred practice of this invention box 14 is 16 by 63½ inches and 13 inches high, while box 18 is 10 by 59½ inches and 10.625 inches high. The distance between the outer walls of the two boxes in use could be 114-120 inches and preferably about 117.45 inches. The invention could be practiced where platform 12 of box 14 is 14-18 inches by 60-66 inches and box 14 is no more than 15 inches high. Platform 16 of box 18 could be 8-10 inches by 56-62 inches and box 18 is no more than 13 inches high. It is to be understood that these dimensions are not intended to limit the invention.

The invention may be practiced in manners other than that described, within the spirit of this invention. For example, in its broad practice the levels of difficulty could include a single rigid bar and a single or preferably multiple flexible straps with the exact number being selected in accordance with the intended desire for the numbers of difficulty levels.

As noted, one of features of the invention is the ability to vary the tension of the flexible straps. A ratchet/pawl is illustrated. The invention may be practiced, however, with any suitable types of tensioning structure. Other variations of the invention will also be apparent to those of ordinary skill in the art.

What is claimed is:

1. A balance trainer exercise device comprising a first member having an upper wall which comprises a first elongated and elevated first platform, a second member having an upper wall which comprises a second elongated and elevated second platform spaced from said first platform, at least one elongated rigid bar having an upper exercise surface, said at least one rigid bar mounted to an upper portion of said first member and an upper portion of said second member and interconnecting said first member and said second member, at least one elongated flexible strap mounted to an upper portion of said first member and an upper portion of said second member, said at least one flexible strap having an upper exercise surface, and said at least one rigid bar and said at least one flexible strap being mounted to said first member and said second member at generally the same elevation as each other and being oriented in an exposed side by side relationship with respect to each other between said first member and said second member.

2. A method of balance training comprising providing the device of claim 1, a user selectively (a) standing on either one of said platforms, then (b) walking from said one platform to the other of said platforms by walking on the exercise surface of the at least one bar, then (c) standing on either one of said platforms, and (d) walking on the exercise surface of the at least one strap.

3. The device of claim 1 wherein each of said platforms is flat.

4. The device of claim 1 wherein said at least one rigid bar comprises two rigid bars of differing width.

5. The device of claim 1 wherein said at least one flexible strap comprises a plurality of flexible straps of differing widths.

6. The device of claim 1 wherein said at least one rigid bar comprises two rigid bars, said at least one flexible strap comprising a plurality of flexible straps located between said two rigid bars, and said plurality of flexible straps and said two rigid bars being parallel to each other.

7. The device of claim 1 wherein each of said platforms has a length dimension oriented in the same orientation as said at least one rigid bar and the orientation of said at least one flexible strap, each of said platforms having a width dimension oriented transverse to the orientation of said at least one rigid bar and said at least one flexible said, and said second platform having a length of at least 8 inches.

8. The device of claim 7 wherein said second platform has a width of at least 56 inches, said first platform having a length of at least 14 inches, and said first platform having a width of at least 60 inches.

9. A balance trainer exercise device comprising a first platform, a second platform spaced from said first platform, at least one elongated rigid bar having an upper exercise surface, said at least one rigid bar interconnecting said first platform and said second platform, at least one elongated flexible strap mounted to said first platform and said second platform, said at least one flexible strap having an upper exercise surface, said at least one bar being a first bar, a second elongated rigid bar having an upper exercise surface interconnecting said first platform to said second platform, said upper surface of said first bar being wider than said upper surface of said second bar to provide different levels of balance difficulty, and said at least one flexible strap comprising a plurality of straps having different widths.

10. The device of claim 9 wherein said first platform is the top wall of a first box, and said second platform being the top wall of a second box.

11. The device of claim 10 wherein said first platform is movable to expose the interior of said first box, and said second platform is movable to expose the interior of said second box.

12. The device of claim 11 wherein said first platform is movable by being hinged to an outer wall of said first box, and said second platform is movable by being hinged to an outer wall of said second box.

13. The device of claim 11 wherein said first bar comprises two bar segments abutting each other and detachably mounted to a supporting first foot, and said second bar comprises two bar segments abutting each other and detachably mounted to a supporting second foot.

14. The device of claim 13 wherein each of said first bar and said second bar is detachably mounted to said first box and said second box, and each of said straps is detachably mounted to said each of said first box and said second box.

15. The device of claim 14 wherein each of said first box and said second box includes bar mounting structure in the interior of said first box and said second box, said first bar and said second bar being detachably mounted to said bar mounting structure, each of said first box and of said second box having U-shaped brackets in its interior, and each of said straps being detachably mounted to said U-shaped brackets in said first box and said second box.

16. The device of claim 14 wherein each of said first box and said second box includes an inner wall, each inner wall of said first box and said second box having openings through which said first bar and said second bar are inserted, each of said first platform and said second platform having a downwardly extending lip, and each lip in said first platform and said second platform having slots through which said straps pass.

17. The device of claim 14 including tensioning structure for adjusting the degree of tension in said straps to control the level of difficulty of the user walking on said straps.

18. The device of claim 17 wherein said tensioning structure comprises a U-shaped bracket for each of said straps mounted in at least one of said first box and said second box, each U-shaped bracket having a set of aligned holes, a shaft extending through each set of said aligned holes, said shaft having a slot for engagement with an end of a respective strap, said shaft being mounted to a ratchet, and a pawl selectively engageable with different teeth in said ratchet.

19. The device of claim 10 wherein said plurality of straps comprises a wide strap and a narrow strap and an intermediate strap, said wide strap having a width of 3-5 inches, said narrow strap having a width of ½-1½ inches, said intermediate strap having a width of 1½-2½ inches, said first platform having a length of 14-18 inches, said second platform having a length of 8-12 inches, each of said first bar and said second bar having a length of 6-10 feet, said first bar having a width of 3-5 inches, said second bar having a width of 1-3 inches, and said first box being no more than 15 inches high.

20. A balance trainer exercise device comprising a first platform, a second platform spaced from said first platform, an elongated rigid bar detachably connected to and interconnecting said first platform and said second platform, at least one flexible strap mounted to said first platform and said second platform, said first platform being the top wall of a box having a plurality of walls and having a hollow interior, one of said walls being movable to expose said interior, and said interior being of sufficient size to house said second platform and said at least one bar and said at least one strap to provide a compact unit when said device is in a storage/transport condition.

21. The device of claim 20 wherein said box is a first box, said second platform being the top wall of a second box, and said at least one flexible strap comprising a plurality of straps.

22. The device of claim 21 wherein said first bar comprises a plurality of segments detachably mounted to a first foot, and said second bar comprises a plurality of segments detachably mounted to a second foot.

23. The device of claim 22 wherein said first platform is hinged to an outer wall of said first box to comprise said one movable wall, and said second platform is hinged to an outer wall of said second box to selectively expose the interior of said second box.

24. The device of claim 22 wherein at least one wheel is mounted to an end wall of said first box to facilitate the movement of said first box, and a handle being mounted to an opposite end wall of said first box.

25. The device of claim 22 wherein tensioning structure is provided in at least one of said first box and said second box for each of said straps, said tensioning structure comprising a U-shaped bracket for each of said straps, a shaft extending through aligned holes in said U-shaped bracket, each respective strap being detachably mounted to a respective shaft, said shaft being mounted to a ratchet, and a pawl for selective engagement with respective teeth in said ratchet.

26. The device of claim 22 wherein said first foot and said second foot are mounted in said second box after being detached from said first bar and said second bar, said second box being mounted in the interior of said first box while housing said first foot and said second foot, said first bar segments and said second bar segments being mounted in the interior of said first box, and said straps being located in one of said first box and said second box.

* * * * *